US010253388B2

(12) United States Patent
Cho et al.

(10) Patent No.: US 10,253,388 B2
(45) Date of Patent: Apr. 9, 2019

(54) STEEL SHEET FOR HOT PRESS FORMED PRODUCT HAVING SUPERIOR BENDABILITY AND ULTRA-HIGH STRENGTH, HOT PRESS FORMED PRODUCT USING SAME, AND METHOD FOR MANUFACTURING SAME

(71) Applicant: POSCO, Pohang-si, Gyeongsangbuk-do (KR)

(72) Inventors: Yeol-Rae Cho, Gwangyang-si (KR); Jae-Hoon Lee, Gwangyang-si (KR); Jin-Keun Oh, Gwangyang-si (KR); Sim-Kun Min, Gwangyang-si (KR); Chang-Sig Choi, Gwangyang-si (KR)

(73) Assignee: POSCO, Pohang-si, Gyeongsangbik-do (KR)

( * ) Notice: Subject to any disclaimer, the term of this patent is extended or adjusted under 35 U.S.C. 154(b) by 20 days.

(21) Appl. No.: 15/107,452

(22) PCT Filed: Dec. 22, 2014

(86) PCT No.: PCT/KR2014/012645
§ 371 (c)(1),
(2) Date: Jun. 22, 2016

(87) PCT Pub. No.: WO2015/099382
PCT Pub. Date: Jul. 2, 2015

(65) Prior Publication Data

US 2016/0312331 A1 Oct. 27, 2016

(30) Foreign Application Priority Data

Dec. 25, 2013 (KR) ..... 10-2013-0163384

(51) Int. Cl.

| | |
|---|---|
| ***C21D 9/46*** | (2006.01) |
| ***C21D 8/02*** | (2006.01) |
| ***C22C 38/00*** | (2006.01) |
| ***C22C 38/04*** | (2006.01) |
| ***C22C 38/02*** | (2006.01) |
| ***C22C 38/06*** | (2006.01) |
| ***C22C 38/20*** | (2006.01) |
| ***C22C 38/28*** | (2006.01) |
| ***C22C 38/32*** | (2006.01) |
| ***C22C 38/42*** | (2006.01) |
| ***C22C 38/44*** | (2006.01) |
| ***C22C 38/50*** | (2006.01) |
| ***C22C 38/54*** | (2006.01) |
| ***C23C 2/12*** | (2006.01) |
| *C21D 7/13* | (2006.01) |

(52) U.S. Cl.
CPC ..... *C21D 9/46* (2013.01); *C21D 8/02* (2013.01); *C21D 8/0205* (2013.01); *C21D 8/0263* (2013.01); *C22C 38/00* (2013.01); *C22C 38/001* (2013.01); *C22C 38/002* (2013.01); *C22C 38/02* (2013.01); *C22C 38/04* (2013.01); *C22C 38/06* (2013.01); *C22C 38/20* (2013.01); *C22C 38/28* (2013.01); *C22C 38/32* (2013.01); *C22C 38/42* (2013.01); *C22C 38/44* (2013.01); *C22C 38/50* (2013.01); *C22C 38/54* (2013.01); *C23C 2/12* (2013.01); *C21D 7/13* (2013.01); *C21D 2211/001* (2013.01); *C21D 2211/002* (2013.01); *C21D 2211/005* (2013.01)

(58) Field of Classification Search
None
See application file for complete search history.

(56) References Cited

U.S. PATENT DOCUMENTS

| | | | | |
|---|---|---|---|---|
| 6,296,805 | B1 | 10/2001 | Laurent et al. | |
| 2013/0095347 | A1 | 4/2013 | Kawasaki et al. | |
| 2013/0199676 | A1* | 8/2013 | Tomokiyo | C21D 9/46 148/518 |
| 2013/0292009 | A1 | 11/2013 | Hayashi et al. | |
| 2014/0004378 | A1 | 1/2014 | Tanahashi et al. | |
| 2014/0044987 | A1 | 2/2014 | Tanahashi et al. | |
| 2014/0056753 | A1 | 2/2014 | Naitou et al. | |
| 2015/0118098 | A1* | 4/2015 | Valls | C21D 9/00 420/102 |

FOREIGN PATENT DOCUMENTS

| | | | |
|---|---|---|---|
| CN | 1531604 | A | 9/2004 |
| CN | 103314120 | A | 9/2013 |
| EP | 2581465 | A1 | 4/2013 |
| GB | 1490535 | A | 11/1977 |
| JP | 2003-034845 | A | 2/2003 |
| JP | 2003-034855 | A | 2/2003 |
| JP | 2003034845 | * | 2/2003 |

(Continued)

OTHER PUBLICATIONS

Extended European Search Report dated Dec. 22, 2016 issued in European Patent Application No. 14875336.1.
International Search Report dated Mar. 31, 2015 issued in International Patent Application No. PCT/KR2014/012645 (English translation).
Japanese Office Action dated Oct. 3, 2017 issued in Japanese Patent Application No. 2016-542988 (with English translation).
European Office Action dated Nov. 23, 2017 issued in European Patent Application No. 14875336.1.
Chinese Office Action dated Feb. 17, 2017 issued in Chinese Patent Application No. 201480071364.7.

*Primary Examiner* — Daniel J. Schleis
(74) *Attorney, Agent, or Firm* — Morgan Lewis & Bockius LLP

(57) ABSTRACT

The present invention provides: a steel sheet capable of manufacturing a formed product having superior bendability and ultra-high strength when compared with conventional steel sheets for manufacturing a hot press formed product; the formed product having superior bendability and ultra-high strength by using the same; and a method for manufacturing the same.

8 Claims, No Drawings

(56) References Cited

FOREIGN PATENT DOCUMENTS

| | | | | |
|---|---|---|---|---|
| JP | 2005-126733 | A | | 5/2005 |
| JP | 2008-214752 | A | | 9/2008 |
| JP | 2010-121209 | A | | 6/2010 |
| JP | 2011-137210 | A | | 7/2011 |
| JP | 2012-031462 | A | | 2/2012 |
| JP | 2013-151708 | A | | 8/2013 |
| KR | 10-2009-0124263 | A | | 12/2009 |
| WO | 02/103073 | A2 | | 12/2002 |
| WO | 2007/129676 | A1 | | 11/2007 |
| WO | 2009/145563 | A2 | | 12/2009 |
| WO | 2012/053642 | A1 | | 4/2012 |
| WO | WO2012053637 | | * | 4/2012 |
| WO | 2012/128225 | A1 | | 9/2012 |
| WO | 2012/147863 | A1 | | 11/2012 |
| WO | 2012/169639 | A1 | | 12/2012 |
| WO | WO2013167580 | | * | 11/2013 |

* cited by examiner

STEEL SHEET FOR HOT PRESS FORMED PRODUCT HAVING SUPERIOR BENDABILITY AND ULTRA-HIGH STRENGTH, HOT PRESS FORMED PRODUCT USING SAME, AND METHOD FOR MANUFACTURING SAME

RELATED APPLICATIONS

This application is the U.S. National Phase under 35 U.S.C. § 371 of International Application No. PCT/KR2014/012645, filed on Dec. 22, 2014, which in turn claims the benefit of Korean Patent Application No. 10-2013-0163384, filed on Dec. 25, 2013, the disclosure of which applications are incorporated by reference herein.

TECHNICAL FIELD

The present disclosure relates to a steel sheet for manufacturing a product such as a pillar reinforcing member, a cross member, a side member, or front or rear bumper through a hot press forming process, a hot press formed product manufactured using the steel sheet, and methods for manufacturing the steel sheet and the hot press formed product. More particularly, the present disclosure relates to a steel sheet for manufacturing a hot press formed product having high bendability and ultra-high strength, a hot press formed product manufactured using the steel sheet, and methods for manufacturing the steel sheet and the hot press formed product.

BACKGROUND ART

Safety regulations for protecting vehicle passengers as well as fuel efficiency regulations for protecting the environment have recently been tightened, and thus there is increasing interest in techniques for improving the stiffness of automobile components and reducing the weight of automobiles. For example, along with attempts to reduce the weight of parts such as pillar reinforcing members or cross members forming passenger safety cage zones in automobiles as well as side members or front/rear bumpers forming crash zones in automobiles, the use of high-strength parts has been increased to guarantee stiffness and crashworthiness.

In automotive steel sheets, the increase of strength may inevitably result in the increase of yield strength, decrease in elongation, and significantly decreased formability. Thus, as a forming method for solving problems related to the formability of high-strength steel and providing high-strength automotive parts having a tensile strength grade of 1470 MPa or greater, a hot press forming method or a hot forming method has been developed and widely used.

Hot press forming guarantees various degrees of strength. For example, in the early 2000s, hot press formed products having a tensile strength grade of 1500 MPa could be manufactured using 22MnB5 steel, as stated in DIN. In general, before hot press forming process, a steel sheet blank having a tensile strength of 500 MPa to 800 MPa is heated to a temperature within an austenite temperature range of an Ac3 transformation temperature or higher and is transferred to the press equipped with a cooling device to form the blank and quench the press formed blank (product) in the dies. Therefore, a press formed product ultimately contains martensite or a mixture of martensite and bainite, and thus the press formed product may have ultra-high strength, on the level of 1500 MPa or greater. In addition, since a press formed product is rapidly cooled within dies, the press formed product may have precise dimensions.

The basic concept of the hot press forming method and the use of boron bearing steel in the hot press forming method were first proposed in Patent Document 1 (UK Patent No. 1490535) and have subsequently been widely used. In addition, an aluminum or aluminum alloy coated steel sheet has been proposed in Patent Document 2 (U.S. Pat. No. 6,296,805) to suppress the formation of surface oxide layer during heating in the hot press forming process. In addition, Zn-coated galvanized or galvannealed steel sheets have been proposed for applications which required sacrificial protection such as wet area of automotive body.

In addition, so as to improve the fuel efficiency of automobiles, automobile manufacturers have been increasingly interested in the higher tensile strength grade of steel sheets for hot press forming. In this regard, a steel sheet for manufacturing a hot press formed product having a tensile strength grade of 1800 MPa has been proposed. Compared to steel sheets for manufacturing hot press formed products having a tensile strength grade of 1500 MPa, the proposed steel sheet has a relatively high carbon content, and niobium (Nb) effective in refinement of initial austenite grains is added to the proposed steel sheet to improve the toughness of hot press formed products.

However, the above-described methods of the related art for improving the strength of hot press formed products result in the formation of cracks, an increase in susceptibility to crack propagation, and accordingly, poor bendability.

DISCLOSURE

Technical Problem

Aspects of the present disclosure may provide a steel sheet for manufacturing a hot press formed product having high bendability and ultra-high strength, and a method for manufacturing the steel sheet.

Aspects of the present disclosure may also provide a hot press formed product having high bendability and ultra-high strength, and a method for manufacturing the hot press formed product.

Technical Solution

According to an aspect of the present disclosure, a steel sheet for a formed product having high bendability and ultra-high strength may include C: 0.28 wt % to 0.40 wt %, Si: 0.5 wt % to 1.5 wt %, Mn: 0.5 wt % to 1.2 wt %, Al: 0.01 wt % to 0.1 wt %, Ti: 0.01 wt % to 0.1 wt %, Cr: 0.05 wt % to 0.5 wt %, P: 0.01 wt % or less, S: 0.005 wt % or less, N: 0.01 wt % or less, B: 0.0005 wt % to 0.005 wt %, and at least one selected from the group consisting of Mo: 0.05 wt % to 0.5 wt %, Cu: 0.05 wt % to 0.5 wt %, and Ni: 0.05 wt % to 0.5 wt %, wherein Mn and Si may satisfy $0.05 \leq Mn/Si \leq 2$, and the steel sheet may include a balance of Fe and other inevitable impurities.

According to another aspect of the present disclosure, a formed product having high bendability and ultra-high strength may be manufactured by performing a hot press forming process on a steel sheet, the steel sheet including C: 0.28 wt % to 0.40 wt %, Si: 0.5 wt % to 1.5 wt %, Mn: 0.5 wt % to 1.2 wt %, Al: 0.01 wt % to 0.1 wt %, Ti: 0.01 wt % to 0.1 wt %, Cr: 0.05 wt % to 0.5 wt %, P: 0.01 wt % or less, S: 0.005 wt % or less, N: 0.01 wt % or less, B: 0.0005 wt % to 0.005 wt %, and at least one selected from the group consisting of Mo: 0.05 wt % to 0.5 wt %, Cu: 0.05 wt % to 0.5 wt %, and Ni: 0.05 wt % to 0.5 wt %, wherein Mn and Si may satisfy 0.05≤Mn/Si≤2, and the steel sheet may include a balance of Fe and other inevitable impurities.

According to another aspect of the present disclosure, a method for manufacturing a steel sheet for a formed product having high bendability and ultra-high strength may include: preparing a slab, the slab including C: 0.28 wt % to 0.40 wt %, Si: 0.5 wt % to 1.5 wt %, Mn: 0.5 wt % to 1.2 wt %, Al: 0.01 wt % to 0.1 wt %, Ti: 0.01 wt % to 0.1 wt %, Cr: 0.05 wt % to 0.5 wt %, P: 0.01 wt % or less, S: 0.005 wt % or less, N: 0.01 wt % or less, B: 0.0005 wt % to 0.005 wt %, and at least one selected from the group consisting of Mo: 0.05 wt % to 0.5 wt %, Cu: 0.05 wt % to 0.5 wt %, and Ni: 0.05 wt % to 0.5 wt %, wherein Mn and Si may satisfy 0.05≤Mn/Si≤2, and the slab may include a balance of Fe and other inevitable impurities; reheating the slab to a temperature within a range of 1150° C. to 1250° C.; hot rolling the reheated slab at a temperature within a finish rolling temperature range of an Ar3 transformation temperature to 950° C. so as to form a hot-rolled steel sheet; and coiling the hot-rolled steel sheet at a temperature within a range of 500° C. to 730° C.

According to another aspect of the present disclosure, a method for manufacturing a formed product having high bendability and ultra-high strength may include: preparing a blank of a steel sheet, the steel sheet including C: 0.28 wt % to 0.40 wt %, Si: 0.5 wt % to 1.5 wt %, Mn: 0.5 wt % to 1.2 wt %, Al: 0.01 wt % to 0.1 wt %, Ti: 0.01 wt % to 0.1 wt %, Cr: 0.05 wt % to 0.5 wt %, P: 0.01 wt % or less, S: 0.005 wt % or less, N: 0.01 wt % or less, B: 0.0005 wt % to 0.005 wt %, and at least one selected from the group consisting of Mo: 0.05 wt % to 0.5 wt %, Cu: 0.05 wt % to 0.5 wt %, and Ni: 0.05 wt % to 0.5 wt %, wherein Mn and Si may satisfy 0.05≤Mn/Si≤2, and the steel sheet may include a balance of Fe and other inevitable impurities; heating the blank to a temperature within a range of 850° C. to 950° C.; and manufacturing a formed product by performing a hot press forming process on the blank to form a formed product and cooling the formed product in dies to a temperature of 200° C. or lower.

Advantageous Effects

Embodiments of the present disclosure provide a steel sheet for manufacturing a hot press formed product having ultra-high strength and high bendability, and a hot press formed product manufactured using the steel sheet. The steel sheet and the hot press formed product may be applied to automobile bodies or parts for weight reduction and crashworthiness improvements.

BEST MODE

Embodiments of the present disclosure relate to a steel sheet for manufacturing a hot press formed product having high bendability and ultra-high strength, a hot press formed product formed of the steel sheet, and methods for manufacturing the steel sheet and the hot press formed product.

In general, steel sheets for manufacturing 1500 MPa grade hot press formed products are formed of steel having a chemical composition corresponding to that of 22MnB5 steel, and the content of carbon (C) in such steel sheets may be increased to obtain a higher strength by heat treatment. For example, boron bearing steels such as 30MnB5 steel or 34MnB5 steel may have a degree of strength corresponding to the strength grade of 1800 MPa or 2000 MPa, respectively.

However, the content of manganese (Mn) in such steels is fixed to a range of 1.2 wt % to 1.4 wt %. If the strength of steel sheets for manufacturing hot press formed products or the strength of hot press formed products is increased by adjusting the carbon contents thereof while fixing the content of manganese (Mn) within this range, the formation of cracks and an increase in susceptibility to crack propagation are observed in a bending test. That is, in this case, the bendability of steel sheets for hot press formed products or the bendability of hot press formed products are decreased.

To address these problems, the inventors have reviewed metallographic factors improving the bendability of steel and found that if the formation of a banded structure caused by micro-segregation is decreased before a hot press forming process and a secondary phase is uniformly distributed, bendability can be increased after a hot press forming process, and if a painting baking treatment is performed after a hot press forming process, bendability can be improved as a whole. These improvements are markedly affected by the addition of particular elements.

Thus, so as to solve problems such as a low bendability of a hot press formed product having a high strength, the inventors have invented a new steel sheet for manufacturing a hot press formed product. The metallographic non-uniformity of the steel sheet is reduced by adjusting the composition of the steel sheet and a thermal history that the steel sheet experiences during manufacturing processes, and the steel sheet includes elements increasing the amount of austenite retained in martensite during a painting baking treatment process after a hot press forming process. Thus, the steel sheet has a markedly improved degree of bendability compared to steel sheets of the related art for manufacturing hot press formed products.

Herein, the term "steel sheet for a hot press formed product" or "steel sheet for manufacturing a hot press formed product" may refer to a hot-rolled steel sheet, a cold-rolled steel sheet, or a plated steel sheet for manufacturing a hot press formed product.

Hereinafter, a steel sheet for a hot press formed product having high bendability and ultra-high strength will be described in detail.

According to an exemplary embodiment of the present disclosure, a steel sheet for a hot press formed product having high bendability and ultra-high strength includes C: 0.28 wt % to 0.40 wt %, Si: 0.5 wt % to 1.5 wt %, Mn: 0.5 wt % to 1.2 wt %, Al: 0.01 wt % to 0.1 wt %, Ti: 0.01 wt % to 0.1 wt %, Cr: 0.05 wt % to 0.5 wt %, P: 0.01 wt % or less, S: 0.005 wt % or less, N: 0.01 wt % or less, B: 0.0005 wt % to 0.005 wt %, and at least one selected from the group consisting of Mo: 0.05 wt % to 0.5 wt %, Cu: 0.05 wt % to 0.5 wt %, and Ni: 0.05 wt % to 0.5 wt %, wherein Mn and Si satisfies 0.05≤Mn/Si≤2, and the steel sheet includes the balance of Fe and other inevitable impurities.

Hereinafter, reasons for setting the contents of alloying elements of the steel sheet to be within the above-stated ranges will be described.

Carbon (C): 0.28 wt % to 0.40 wt %

Carbon (C) increases the hardenability of the steel sheet, and after the steel sheet is cooled in dies or quenched, the strength of the steel sheet is markedly affected by the content of carbon (C). If the content of carbon (C) in the steel sheet is less than 0.28 wt %, it may be difficult to obtain a strength of 1800 MPa or greater. Conversely, if the content of carbon (C) in the steel sheet is greater than 0.4 wt %, although a high degree of strength is obtained, the possibility of cracking increases due to the concentration of stress around a weld nugget in a spot welding process after a product forming process. In addition, stress may concentrate around weld zone connecting steel coil-to-coil in the manufacturing process, and thus strip breakage is likely to occur. Therefore, the content of carbon (C) is adjusted to be less than 0.4 wt %.

Silicon (Si): 0.5 wt % to 1.5 wt %

Silicon (Si) markedly helps the steel sheet to have a uniform microstructure and stable strength rather than improving the hardenability of the steel sheet. Like manganese (Mn), silicon (Si) markedly affects the bendability of the steel sheet. As the content of silicon (Si) increases, the formation of a banded structure rich in manganese (Mn) and carbon (C) is reduced, and secondary phases including pearlite are uniformly distributed in the microstructure of the steel sheet before a hot press forming process. In addition, silicon (Si) markedly improves the bendability of the steel sheet by painting baking treatment process after a hot press forming process. If the content of silicon (Si) is less than 0.5 wt %, the microstructure of the steel sheet may not be uniform before a hot press forming process, and thus the bendability of the steel sheet may not be improved after a hot press forming process. Conversely, if the content of silicon (Si) is greater than 1.5 wt %, red scale may be easily formed on a hot-rolled steel sheet, and thus the surface quality of a final product may be negatively affected. In addition, the A3 transformation point of the steel sheet may rise, and thus the heating temperature (solution treatment temperature) of a hot press forming process may be inevitably increased. Therefore, the upper limit of the content of silicon (Si) may be set to be 1.5 wt %.

Manganese (Mn): 0.5 wt % to 1.2 wt %

Like carbon (C), manganese (Mn) improves the hardenability of the steel sheet, and manganese (Mn) has the most decisive effect next to carbon (C) on the strength of the steel sheet after the steel sheet is cooled in dies or quenched. However, as the content of manganese (Mn) increases, the microstructure of the steel sheet becomes less uniform before hot press forming process because banded structure having large amounts of carbon (C) and manganese (Mn) is easily formed. As a result, the bendability of the steel sheet may be poor after the steel sheet is cooled in dies or quenched. If the content of manganese (Mn) is less than 0.5 wt %, although the uniformity of the microstructure of the steel sheet is improved, the steel sheet may not have an intended degree of tensile strength after a hot press forming process. Conversely, if the content of manganese (Mn) is greater than 1.2 wt %, although the strength of the steel sheet is improved, the bendability of the steel sheet is decreased. Therefore, the upper limit of the content of manganese (Mn) may be set to be 1.2 wt %.

Aluminum (Al): 0.01 wt % to 0.1 wt %

Aluminum (Al) is a representative deoxidizer, and this effect may be sufficiently obtained if the content of aluminum (Al) 0.01 wt % or greater. If the content of aluminum (Al) is less than 0.01 wt %, deoxidation may not sufficiently occur. However, if the content of aluminum (Al) is excessively high, aluminum (Al) induces the precipitation of nitrogen (N) during a continuous casting process, thereby leading to surface defects. Therefore, the upper limit of the content of aluminum (Al) may be set to be 0.1 wt %.

Phosphorus (P): 0.01 wt % or Less

Phosphorus (P) is an inevitably added impurity and has substantially no effect on the strength of the steel sheet after a hot press forming process. Moreover, in austenitizing treatment process followed by a hot press forming process, phosphorus (P) may segregate along grain boundaries of austenite and may thus worsen the bendability or fatigue characteristics of the steel sheet. Therefore, in the exemplary embodiment of the present disclosure, the content of phosphorus (P) is limited to 0.01 wt % or less.

Sulfur (S): 0.005 wt % or Less

Sulfur (S) is an impurity, and if sulfur (S) combines with manganese (Mn) and exists in the form of elongated sulfide inclusion, the ductility of the steel sheet may decrease after the steel sheet is cooled in dies or quenched. Therefore, the content of sulfur (S) is adjusted to be 0.005 wt % or less.

Titanium (Ti): 0.01 wt % to 0.1 wt %

During heating in a hot press forming process, TiN, TiC, or TiMoC precipitate suppresses the growth of austenite grains. In addition, if the precipitation of TiN occurs sufficiently, the effective amount of boron (B) improving the hardenability of austenite is increased, and thus the strength of the steel sheet may stably be improved after the steel sheet is cooled in dies or quenched. If the content of titanium (Ti) is less than 0.01 wt %, microstructure refinement or strength improvements may occur insufficient. Conversely, if the content of titanium (Ti) is greater than 0.1 wt %, the strength of the steel sheet may not be improved as much as the added amount of titanium (Ti). Therefore, the upper limit of the content of titanium (Ti) may be set to be 0.1 wt %.

Chromium (Cr): 0.05 wt % to 0.5 wt %

Like manganese (Mn) and carbon (C), chromium (Cr) improves the hardenability of the steel sheet and increases the strength of the steel sheet after the steel sheet is cooled in dies or quenched. In a process of adjusting martensite, chromium (Cr) has an effect on a critical cooling rate, and thus martensite may be easily formed by the addition of chromium (Cr). Furthermore, in a hot press forming process, chromium (Cr) lowers the A3 transformation point of the steel sheet. These effects may be obtained if the content of chromium (Cr) is 0.05 wt % or greater. However, if the content of chromium (Cr) is greater than 0.5 wt %, the surface quality of a coated steel sheet may be decreased, and the spot weldability of the steel sheet may be worsened when hot press formed products are welded together. Therefore, the content of chromium (Cr) may be adjusted to be 0.5 wt % or less.

Boron (B): 0.0005 wt % to 0.005 wt %

Boron (B) is highly effective in improving the hardenability of the steel sheet. Even a very small amount of boron (B) may lead to an increase in the strength of the steel sheet after the steel sheet is cooled in dies or quenched. However, as the content of boron (B) increases, the effect of improving the quenching characteristics of the steel sheet is not increased in proportion to the content of boron (B), and corner defects of slab may be formed during continuous casting process. Conversely, if the content of boron (B) is less than 0.0005 wt %, the quenching characteristics or strength of the steel sheet may not be improved as intended in the exemplary embodiment. Therefore, the upper and lower limits of the content of boron (B) may be set to be 0.005 wt % and 0.0005 wt %, respectively.

Nitrogen (N): 0.01 wt % or Less

Nitrogen (N) is an inevitably added impurity leading to the precipitation of AlN during continuous casting process and cracks in corners of continuous cast slab. In addition, precipitates such as TiN are known as absorbing sites of diffusional hydrogen. Thus, if the precipitation of nitrogen (N) is properly controlled, resistance to hydrogen delayed fracture may be improved. Thus, the upper limit of the content of nitrogen (N) may be set to be 0.01 wt %.

In addition to the above-described alloying elements, the steel sheet may further include at least one selected from the group consisting of molybdenum (Mo), copper (Cu), and nickel (Ni).

Molybdenum (Mo): 0.05 wt % to 0.5 wt %

Like chromium (Cr), molybdenum (Mo) improves the hardenability of the steel sheet and stabilizes the strength of the steel sheet after quenching. In addition, molybdenum (Mo) added to steel widens an austenite temperature range toward a lower temperature and thus broadens a process window when the steel is annealed in hot rolling process and cold rolling process and the steel is heated during hot press forming process. If the content of molybdenum (Mo) is less than 0.05 wt %, the effect of improving hardenability or widening an austenite temperature range may not be obtained. Conversely, if the content of molybdenum (Mo) is greater than 0.5 wt %, even though strength is increased, the strength increasing effect is not high compared to the amount of molybdenum (Mo). That is, it is not economical. Thus, the upper limit of the content of molybdenum (Mo) may be set to be 0.5 wt %.

Copper (Cu): 0.05 wt % to 0.5 wt %

Copper (Cu) improves the corrosion resistance of the steel sheet. In addition, when a tempering process is performed to improve ductility after a hot press forming process, supersaturated copper (Cu) may lead to the precipitation of ε-carbide and thus age-hardening. If the content of copper (Cu) is less than 0.05 wt %, these effects may not be obtained. Thus, the lower limit of the content of copper (Cu) may be set to be 0.05 wt %. Conversely, if copper (Cu) is excessively added, surface defects may be formed during steel sheet manufacturing process, and the corrosion resistance of the steel sheet may not be highly increased as compared to the amount of copper (Cu). That is, it may be uneconomical. Thus, the upper limit of the content of copper (Cu) may be set to be 0.5 wt %.

Nickel (Ni): 0.05 wt % to 0.5 wt %

Nickel (Ni) is effective in improving the strength, ductility, quenching characteristics of the steel sheet. If copper (Cu) is only added to the steel sheet, the steel sheet may become susceptible to hot shortening. However, nickel (Ni) decreases the susceptibility of the steel sheet to hot shortening. In addition, nickel (Ni) added to steel widens an austenite temperature range toward a lower temperature and thus broadens a process window when the steel is annealed in a hot rolling process and a cold rolling process and the steel is heated in a hot press forming process. If the content of nickel (Ni) is less than 0.05 wt %, the above-mentioned effects may not be obtained. Conversely, if the content of nickel (Ni) is greater than 0.5 wt %, even though the quenching characteristics and strength of the steel sheet are improved, the effect of improving quenching characteristics is not high compared to the amount of nickel (Ni). That is, it is not economical. Thus, the upper limit of the content of nickel (Ni) may be set to be 0.5 wt %.

The contents of manganese (Mn) and silicon (Si) may satisfy $0.05 \leq Mn/Si \leq 2$.

In terms of the ratio of Mn and Si contents (Mn/Si), as the content of manganese (Mn) increases, a banded structure is easily formed in the microstructure of the steel sheet before a hot press forming process, and thus the bendability of the steel sheet may be worsened after the steel sheet is cooled in dies or quenched. In addition, as the content of silicon (Si) increases, the formation of a banded structure rich in manganese (Mn) and carbon (C) is reduced, and a secondary phase structure including pearlite is uniformly distributed in the microstructure of the steel sheet before a hot press forming process. In addition, silicon (Si) markedly improves the bendability of the steel sheet in a painting baking treatment process after a hot press forming process. These effects are determined by the ratio of Mn/Si. If silicon (Si) is excessively added and thus the ratio of Mn/Si is less than 0.05, coating quality is worsened. Conversely, if manganese (Mn) is excessively added and thus the ratio of Mn/Si is greater than 2, a banded structure may be formed, and thus the bendability of the steel sheet may be decreased. Therefore, the upper and lower limits of the ratio of Mn/Si are set to be 2.0 and 0.05, respectively.

In the exemplary embodiment of the present disclosure, the other component of the steel sheet is iron (Fe).

However, impurities of raw materials or manufacturing environments may be inevitably included in the steel sheet, and such impurities may not be able to be removed from the steel sheet. Such impurities are well-known to those of ordinary skill in the art to which the present disclosure relates, and thus descriptions thereof will not be given in the present disclosure.

The steel sheet may be one selected from the group consisting of a hot-rolled steel sheet, a cold-rolled steel sheet, and a coated steel sheet.

The steel sheet of the exemplary embodiment having the above-described chemical composition may be used in the form of a hot-rolled steel sheet, a pickled and oiled steel sheet, or a cold-rolled steel sheet, or coated steel sheet. In this coated steel case, surface oxidation of the steel sheet may be prevented, and the corrosion resistance of the steel sheet may be improved.

The coated steel sheet may be an aluminum alloy coated steel sheet obtained by forming an aluminum alloy coating layer on a hot-rolled steel sheet, a pickled and oiled steel sheet, or a cold-rolled steel sheet. The aluminum alloy coating steel sheet may include an alloy coating layer containing at least one selected from the group consisting of silicon (Si): 8 wt % to 10 wt % and magnesium (Mg): 4 wt % to 10 wt %, and the balance of aluminum (Al), iron (Fe), and other impurities. An inhibition layer may be disposed between the alloy coating layer and the steel sheet (base steel sheet).

The steel sheet may have a microstructure including ferrite and pearlite or a microstructure including ferrite, pearlite, and bainite. Preferably, the microstructure of the steel sheet may include ferrite and less than 40% of pearlite, or the microstructure of the steel sheet may include ferrite and less than 40% of pearlite and bainite.

Preferably, the strength of the steel sheet may be within the range of 800 MPa or less in tensile strength. The reason for this is as follows. Before a hot press forming process is performed on the steel sheet prepared as a hot-rolled pickled steel sheet, a cold-rolled steel sheet, or a coated steel sheet as described above, blanks of the steel sheet corresponding to the shapes of products to be manufactured are prepared. At this time, if the strength of the steel sheet is excessively high, blanking dies may easily wear and break, and the noise of a blanking process may increase in proportion to the strength of the steel sheet.

Therefore, preferably, the steel sheet may have a tensile strength within the range of 800 MPa or less, and may include ferrite and less than 40% of secondary phases such as pearlite and bainite.

Hereinafter, a hot press formed product will be described in detail according to an exemplary embodiment of the present disclosure.

The hot press formed product of the exemplary embodiment is manufactured by performing a hot press forming process on the above-described steel sheet. The hot press formed product may have high bendability and ultra-high strength. The steel sheet may be one selected from the group consisting of a hot-rolled steel sheet, a cold-rolled steel sheet, and a coated steel sheet. The coated steel sheet may be an aluminum alloy coated steel sheet obtained by forming an aluminum alloy coated layer on a hot-rolled steel sheet, a pickled steel sheet, or a cold-rolled steel sheet.

The hot press formed product may be manufactured by performing a hot press forming process on the aluminum alloy coated steel sheet. The hot press formed product may include an Fe—Al film layer containing at least one selected from the group consisting of silicon (Si): 4 wt % to 10 wt % and magnesium (Mg): 2 wt % to 10 wt %, and other impurities. The Fe—Al film layer may be formed as the coating layer of the aluminum alloy coated steel sheet undergoes alloying in the hot press forming process. The Fe—Al film layer may include an $Fe_3Al$+FeAl layer (inter diffusion layer), an $Fe_2Al_5$ layer, and an Fe—Al layer that are sequentially formed on a base steel sheet (that is, on an iron surface of the aluminum alloy coated steel sheet). In addition, since alloying occurs between the alloying layer and the base steel sheet during the hot press forming process, the Fe—Al film layer may have a relatively high iron content and thus a relatively low silicon content and/or a relatively low manganese content when compared to the plating layer before the hot press forming process.

The microstructure of the hot press formed product may include martensite in an amount of 90 area % or greater and the balance of at least one of bainite and ferrite.

Preferably, the hot press formed product may have a tensile strength of 1700 MPa or greater.

If the hot press formed product is manufactured using a hot-rolled steel sheet or a cold-rolled steel sheet, the hot press formed product may preferably have a tensile strength of 1800 MPa or greater and a tensile strength×bendability balance of 115,000 MPa·° or greater.

If the hot press formed product is manufactured using an aluminum alloy coated steel sheet, the hot press formed product may preferably have a tensile strength of 1800 MPa or greater and a tensile strength×bendability balance of 100,000 MPa·° or greater.

If the hot press formed product is manufactured using a hot-rolled steel sheet or a cold-rolled steel sheet, the hot press formed product may preferably have a tensile strength of 2000 MPa or greater and a tensile strength×bendability balance of 95,000 MPa·° or greater.

If the hot press formed product is manufactured using an aluminum alloy plated steel sheet, the hot press formed product may preferably have a tensile strength of 2000 MPa or greater and a tensile strength×bendability balance of 85,000 MPa·° or greater.

Hereinafter, a method of manufacturing a steel sheet for a hot press formed product will be described in detail according to an exemplary embodiment of the present disclosure.

According to the exemplary embodiment of the present disclosure, a steel sheet having high bendability and ultra-high strength and suitable for a hot press forming process is manufactured. The method includes: preparing a slab having the composition of the steel sheet of the previous embodiment; reheating the slab to a temperature within a range of 1150° C. to 1250° C.; hot rolling the reheated slab at a temperature within a finish rolling temperature range of an Ar3 transformation temperature to 950° C. so as to form a hot-rolled steel sheet; and coiling the hot-rolled steel sheet at a temperature within a range of 500° C. to 730° C.

Since the slab is reheated to a temperature within a range of 1150° C. to 1250° C., the microstructure of the slab may become uniform, and carbonitride precipitates such as titanium (Ti) precipitates may be sufficiently re-dissolved, thereby preventing grains of the slab from growing excessively.

The hot rolling process is performed at a finish rolling temperature of an Ar3 transformation temperature to 950° C. If the finish rolling temperature is lower than an Ar3 transformation temperature, austenite may be partially transformed into ferrite, and a two phase region (in which ferrite and austenite exist together) may be formed. In this state, if a hot rolling process is performed, deformation resistance may not be uniform, and thus the mass flow of the strip may be negatively affected. In addition, stress may concentrate on ferrite phases, and fracture may occur. Conversely, if the finish rolling temperature is higher than 950° C., surface detects such as sand-like scale may be formed. Therefore, the finish rolling temperature may be set to be within the range of an Ar3 transformation temperature to 950° C.

Next, when the hot-rolled steel sheet is cooled and coiled, the coiling temperature may be properly adjusted so as to reduce widthwise mechanical property deviation of the hot-rolled steel sheet and prevent the formation of a low-temperature phase such as martensite having a negative influence on the mass flow of the steel sheet in a subsequent cold rolling process. That is, preferably, the coiling temperature may be set to be within the range of 500° C. to 730° C.

If the coiling temperature is lower than 500° C., a low-temperature microstructure such as martensite may be formed, and thus the strength of the hot-rolled steel sheet may be excessively increased. Particularly, if the hot-rolled steel sheet is overcooled in the edges of coil, material properties of the coiled steel sheet may be varied in the width direction, and the mass flow of the steel sheet may be negatively affected in a subsequent cold rolling process, thereby making it difficult to control the thickness of the steel sheet.

Conversely, if the coiling temperature is higher than 730° C., oxides may be formed on the surface region of the steel sheet, and cracks may be formed on the surface region of the steel sheet after such internal oxides are removed through a pickling process. In this state, if the steel sheet is coated, the interface between the steel sheet (base steel sheet) and a coating layer may be uneven. This may worsen the bendability of the steel sheet together with the internal oxides in a subsequent hot press forming process. Therefore, the upper limit of the coiling temperature may be set to be 730° C.

According to the exemplary embodiment, the hot-rolled steel sheet may be pickled and cold rolled. Then, a continuous annealing process may be performed on the steel sheet at a temperature within a range of 750° to 850° C., and an overaging heat treatment process may be performed on the steel sheet at a temperature within a range of 400° C. to 600° C. In this manner, a cold-rolled steel sheet may be manufactured.

The pickling and cold rolling are not limited to particular methods. For example, the pickling and cold rolling may be performed by generally-used methods. A reduction ratio of the cold rolling is not limited. For example, it may be preferable that the reduction ratio be within the range of 40% to 70%.

The continuous annealing process may be performed at a temperature within a range of 750° C. to 850° C. If the continuous annealing temperature is lower than 750° C., recrystallization may not sufficiently occur. If the continuous annealing temperature is higher than 850° C., coarse grains may be formed, and much heating cost may be required.

Next, the overaging heat treatment process may be performed at a temperature within a range of 400° C. to 600° C. so as to obtain a final microstructure in which pearlite or bainite is partially included in a ferrite matrix. In this case, the cold-rolled steel sheet may have strength range within 800 MPa or less like the hot-rolled steel sheet.

According to the exemplary embodiment of the present disclosure, after the hot-rolled steel sheet is pickled and cold rolled, the steel sheet may be annealed at a temperature equal to or greater than 700° C., and less than an Ac3 transformation temperature and may be coated with an aluminum alloy coating layer to manufacture an aluminum alloy coated steel sheet.

Preferably, the annealing process may be performed at a temperature equal to or great than 700° C., and less than an Ac3 transformation temperature. The annealing temperature may be determined by taking the final softening of the steel sheet and the temperature at which the steel sheet is dipped into a coating path in a subsequent coating process into consideration. If the annealing temperature is too low, recrystallization may occur insufficiently, and the temperature of the steel sheet may be low when being dipped into a coating bath, thereby leading to unstable adhesion of a coating layer and poor coating quality. Therefore, the lower limit of the annealing temperature may be set to be 700° C. If the annealing temperature is too high, coarse grains may be formed, and the strength of a coated steel sheet may be excessively increased by the formation of a low temperature transformation phase from austenite during annealing, coating, and cooling processes. Therefore, the upper limit of the annealing temperature may be set to be less than an Ac3 transformation temperature.

An alloy coating bath used in the process of forming the aluminum alloy coated steel sheet may include at least one selected from the group consisting of silicon (Si): 8 wt % to 10 wt % and magnesium (Mg): 4 wt % to 10 wt %, and the balance of aluminum (Al), iron (Fe), and other impurities.

The amount of the coated layer may preferably be 120 $g/m^2$ to 180 $g/m^2$ based on both sides.

The coating layer may be formed by a hot dipping method.

In the hot dipping method, when the steel sheet is cooled after coating the steel sheet by dipping the steel sheet in the coating bath, the rate of cooling and the speed of a cooling line are not limited.

This is allowed because of the annealing temperature lower than an Ac3 transformation temperature and one of the characteristics of the manufacturing method of the exemplary embodiment. That is, if the steel sheet is heated to Ac3 transformation temperature or higher in the annealing process and dipped into the coating bath, and then the coated steel sheet is cooled at a critical cooling rate or faster, the strength of the coated steel sheet may be excessively increased because of the formation of martensite. However, according to the exemplary embodiment, since the annealing process is performed at a temperature less than an Ac3 transformation temperature, factors leading to phase-transformation-induced material property variations may be markedly decreased, and thus the above-mentioned problems may not occur.

Thus, the cooling rate and cooling line speed may be determined by taking the productivity of a coating line and economical aspects into account. In view of the microstructure of the steel sheet dependent on the cooling rate, the cooling rate may be adjusted to enable the formation of a ferrite-pearlite microstructure or a microstructure in which spheroidized cementite exists in a ferrite matrix.

Hereinafter, a method of manufacturing a hot press formed product will be described in detail according to an exemplary embodiment of the present disclosure.

The method of the exemplary embodiment may include: preparing a blank of the above-described steel sheet; heating the blank to a temperature within a range of 850° C. to 950° C.; and performing a hot press forming process on the heated blank to manufacture a hot press formed product.

The blank is heated to a temperature within a range of 850° C. to 950° C. If the heating temperature is lower than 850° C., ferrite transformation may occur from the surface of the blank because the blank is cooled during transfer of the blank from furnace to die. In this case, even after a subsequent heat treatment, martensite may not be sufficiently formed throughout the thickness of the blank, and an intended degree of strength may not be obtained. Conversely, if the heating temperature is higher than 950° C., austenite grains may become coarse, and more heating power may be consumed, thereby increasing manufacturing costs. In addition, if the steel sheet from which the blank is prepared is a cold-rolled steel sheet, decarbonization may be facilitated, and thus after a final heat treatment process, the strength of hot press formed products may be low. Thus, the upper limit of the heating temperature may be set to be 950° C.

After heating the blank to the temperature within a range of 850° C. to 950° C., the blank may be maintained within the temperature range for 60 seconds to 600 seconds. The temperature range is basically set for heating the blank to an austenite region. According to another aspect, if the temperature range is lower than 850° C., ferrite may not be completely dissolved, and if the temperature range is higher than 950° C., surface oxidation may occur along austenite grain boundaries, thereby decreasing interfacial strength and worsening bendability. Therefore, the upper limit of the temperature range may be set to be 950° C. If the heated blank is maintained within the temperature range for a period of time shorter than 60 seconds, ferrite is likely to remain unintendedly. If the heated blank is maintained with the temperature range for a period of time longer than 600 seconds, a thick aluminum-containing oxide layer may be formed on the surface, thereby leading to poor spot weldability. Therefore, the heated blank may be maintained within the temperature range of 850° C. to 950° C. for 60 seconds to 600 seconds.

The blank heated as described above may be hot-formed and simultaneously cooled in dies within 12 seconds after the blank is removed from the heating furnace. As described above, the blank having the chemical composition proposed in the exemplary embodiment of the present disclosure is cooled at a critical cooling rate or faster so as to obtain a microstructure having a martensite matrix. Although the cooling rate of the blank is increased to be higher than critical cooling rate to obtain martensite matrix at which transformation to martensite occurs, the strength of the blank is not highly increased compared to the increased cooling rate, but additional pieces of cooling equipment may be required. That is, it is not economical. Therefore, the cooling rate of the blank may be set to be 300° C./s or less.

After the blank is hot-formed (hot press forming), the hot press formed product may be cooled in the dies to a temperature lower than 200° C. to finish transformation to martensite.

In addition, a trimming process may be performed on the hot press formed product, and other parts may be coupled to the hot press formed product to form an assembly. Then, a painting baking treatment process may be performed on the assembly preferably at a temperature within a range of 150° C. to 200° C. for 10 minutes to 30 minutes. The temperature range and process time of the painting baking treatment process are set as described above in consideration of optimal drying conditions after painting. That is, if the temperature range is lower than 150° C., a drying time may be excessively long, and if the temperature range is higher than 200° C., strength may decrease. In addition, if the process time (maintaining period of time) is shorter than 10 minutes, bake hardening may occur insufficiently, and if the process time is excessively long, bake hardening may occur excessively and strength may decrease.

For example, the hot press formed product may be manufactured using an aluminum alloy coated steel sheet through the above-described method. In this case, the hot press formed product manufactured using an aluminum alloy coated steel sheet may include an Fe—Al film layer containing at least one selected from the group consisting of silicon (Si): 4 wt % to 10 wt % and magnesium (Mg): 2 wt % to 10 wt %, and other impurities.

Preferably, the hot press formed product may have a microstructure including martensite in an amount of 90 area % or greater, retained austenite in an amount of less than 5 area %, and the balance of at least one selected from retained bainite and ferrite.

Preferably, the hot press formed product may have a tensile strength of 1700 MPa or greater.

If the hot press formed product is manufactured using a hot-rolled steel sheet or a cold-rolled steel sheet, the hot press formed product may preferably have a tensile strength of 1800 MPa or greater and a tensile strength×bendability balance of 115,000 MPa·° or greater.

If the hot press formed product is manufactured using an aluminum alloy plated steel sheet, the hot press formed product may preferably have a tensile strength of 1800 MPa or greater and a tensile strength×bendability balance of 100,000 MPa·° or greater.

If the hot press formed product is manufactured using a hot-rolled steel sheet or a cold-rolled steel sheet, the hot press formed product may preferably have a tensile strength of 2000 MPa or greater and a tensile strength×bendability balance of 95,000 MPa·° or greater.

If the hot press formed product is manufactured using an aluminum alloy plated steel sheet, the hot press formed product may preferably have a tensile strength of 2000 MPa or greater and a tensile strength×bendability balance of 85,000 MPa·° or greater.

In the above, "°" denotes a angle complementary to a bend angle at a maximum load in a three-point bending test, and the bendability is high, as the bend angle (complementary angle) is large in a bending test.

MODE FOR INVENTION

Hereinafter, the present disclosure will be described more specifically according to examples. However, the following examples should be considered in a descriptive sense only and not for purposes of limitation. The scope of the present invention is defined by the appended claims, and modifications and variations may reasonably made therefrom.

Example 1

Hot press formed products having a strength of 1700 MPa or greater after a hot press forming process, specifically, 1800 Mpa grade hot press formed products, were manufactured as follows. First, slabs having compositions as illustrated in Table 1 were heated to 1200° C. to homogenize the microstructure of the slabs. Thereafter, the slabs are rough rolled, finish rolled, and then coiled at 650° C. so as to manufacture hot-rolled steel sheets having a thickness of 3.0 mm. Then, the hot-rolled steel sheets were pickled and cold rolled at a reduction ratio of 50% so as to manufacture cold rolled full hard steel sheets having a thickness of 1.5 mm. Thereafter, some of the cold rolled full hard steel sheets were annealed at 800° C., and an overaging process was performed while maintaining an entrance temperature to be 500° C. and an exit temperature to be 450° C., so as to manufacture cold-rolled steel sheets. The other of the cold rolled full hard steel sheets were annealed at 780° C. and were dipped into a coating bath including 90% Al-9% Si and a balance of iron (Fe) and other impurities, so as to manufacture aluminum coated (Al—Si coated) steel sheets having a coating weight of 150 g/m$^2$ to 160 g/m$^2$ based on both sides.

Referring to Table 1, since inventive steels included silicon (Si) in an amount of 0.5 wt % or greater, the inventive steels were clearly distinguishable from steels of the related art for hot press forming in terms of the ratio of Mn/Si. Inventive Steels 1 to 9 had an Mn/Si ratio within the range of 0.5 to 2, and steels to which silicon (Si) and manganese (Mn) were added according to the related art had an Mn/Si ratio within the range of 3.6 to 5.0. The steels of the related art were denoted as Comparative Steels 1 to 8 in Table 1. Inventive Steel 5 had an excessive amount of silicon (Si) even though the Mn/Si ratio of Inventive Steel 5 was within the range proposed in the embodiments of the present disclosure. Thus, Inventive Steel 5 had aluminum coating failure and poor coating quality. In Table 1 below, if the content of an element is in ppm, * is attached to the symbol of the element.

TABLE 1

| | Composition (wt %) | | | | | | | | | | | | | Mn/ |
|---|---|---|---|---|---|---|---|---|---|---|---|---|---|---|
| No. | C | Si | Mn | P* | S* | s-Al | Ti | Cr | B* | Mo | Cu | Ni | N* | Si |
| CS 1 | 0.29 | 0.26 | 1.25 | 110 | 24 | 0.029 | 0.029 | 0.16 | 26 | — | — | — | 40 | 4.8 |
| CS 2 | 0.28 | 0.25 | 0.92 | 58 | 12 | 0.030 | 0.030 | 0.40 | 28 | 0.10 | — | — | 40 | 3.7 |
| IS 1 | 0.27 | 0.7 | 0.9 | 55 | 15 | 0.031 | 0.029 | 0.40 | 26 | 0.11 | — | — | 40 | 1.3 |
| IS 2 | 0.27 | 1.2 | 0.91 | 67 | 11 | 0.029 | 0.032 | 0.38 | 25 | 0.09 | — | — | 40 | 0.8 |
| IS 3 | 0.33 | 1.1 | 0.50 | 55 | 14 | 0.031 | 0.029 | 0.40 | 25 | 0.10 | — | — | 40 | 0.5 |
| CS 3 | 0.32 | 0.25 | 0.91 | 79 | 3 | 0.034 | 0.030 | 0.21 | 26 | 0.10 | — | — | 27 | 3.6 |
| CS 4 | 0.32 | 0.26 | 0.89 | 65 | 8 | 0.040 | 0.028 | 0.21 | 20 | 0.08 | — | — | 46 | 3.4 |
| CS 5 | 0.32 | 0.25 | 0.89 | 120 | 25 | 0.034 | 0.034 | 0.15 | 17 | 0.17 | — | — | 35 | 3.6 |
| CS 6 | 0.32 | 0.26 | 0.88 | 120 | 24 | 0.027 | 0.029 | 0.15 | 17 | — | — | — | 38 | 3.4 |
| IS 4 | 0.32 | 0.6 | 0.90 | 82 | | 0.025 | 0.023 | 0.17 | 24 | 0.15 | — | — | 45 | 1.5 |

TABLE 1-continued

| No. | Composition (wt %) C | Si | Mn | P* | S* | s-Al | Ti | Cr | B* | Mo | Cu | Ni | N* | Mn/Si |
|---|---|---|---|---|---|---|---|---|---|---|---|---|---|---|
| IS 5 | 0.30 | 1.5 | 0.90 | 77 | 16 | 0.030 | 0.027 | 0.20 | 27 | — | — | — | 40 | 0.6 |
| CS 7 | 0.32 | 0.26 | 0.89 | 65 | 8 | 0.040 | 0.028 | 0.21 | 20 | 0.08 | — | — | 46 | 3.4 |
| IS 6 | 0.32 | 0.6 | 0.95 | 73 | | 0.033 | 0.030 | 0.15 | 33 | 0.15 | — | — | 27 | 1.6 |
| IS 7 | 0.32 | 0.7 | 1.10 | 55 | | 0.031 | 0.025 | 0.15 | 26 | 0.15 | 0.1 | — | 40 | 1.6 |
| IS 8 | 0.32 | 0.6 | 0.94 | 68 | | 0.023 | 0.027 | 0.20 | 23 | 0.15 | — | 0.15 | 35 | 1.6 |
| IS 9 | 0.31 | 0.8 | 0.90 | 47 | | 0.025 | 0.025 | 0.15 | 27 | 0.20 | 0.33 | 0.20 | 55 | 1.1 |
| CS 8 | 0.32 | 0.26 | 1.25 | 109 | | 0.030 | 0.029 | 0.20 | 30 | — | — | — | 52 | 5.0 |

CS: Comparative Steel,
IS: Inventive Steel

The cold-rolled steel sheets and the aluminum coated steel sheets manufactured as described above were heated to 930° C. for 5 minutes to 7 minutes and were transferred from a heating furnace to a press machine equipped with flat dies in which the steel sheets were cooled. At that time, a period of time from time at which the steel sheets were removed from the heating furnace to time at which the flat dies were closed was 8 seconds to 12 seconds, and the steel sheets were cooled in the flat dies at a cooling rate of 50° C./s to 100° C./s. Then, for painting baking treatment process, the steel sheets were maintained at a temperature of 170° C. to 180° C. for 20 minutes and were air cooled, and the tensile characteristics and bendability of the steel sheets were evaluated. Oxide scale formed on the surfaces of the cold-rolled steel sheets during the above-described processes was removed through a shot blasting process after heat treatment process.

Tensile specimens were taken from the steel sheets in the direction parallel to the rolling direction of the steel sheets according to ASTM370A. A bending test was performed by bending each of 60 mm×20 mm specimens using a 1R punch in the direction perpendicular to the rolling direction (a bend line was parallel with the rolling direction), and measuring a bend angle at the maximum load. Table 2 below illustrates results of evaluation of tensile characteristics and bendability of Inventive Steels 1 to 9 and Comparative Steels 1 to 8 after a hot press forming process and a painting baking treatment process. In Table 2, YS, TS, and El refer to yield strength, tensile strength, and elongation, respectively. In Table 2, Inventive Steels 1 to 4 and Comparative Steels 1 to 6 are those used to form the cold-rolled steel sheets, and Inventive Steels 5 to 9 and Comparative Steels 7 and 8 are those used to form the aluminum coated steel sheets.

TABLE 2

| No. | Mn/Si | Properties after hot press forming (HPF) heat treatment YS | TS | El | Bend angle | TS × Bend angle | Reference | Properties after HPF heat treatment and painting baking treatment YS | TS | El | Bend angle | TS × Bend angle |
|---|---|---|---|---|---|---|---|---|---|---|---|---|
| CS 1 | 4.8 | 1264 | 1827 | 6.8 | 57.2 | 104,453 | >110,000 | 1361 | 1701 | 6.3 | 60.1 | 102,230 |
| CS 2 | 3.7 | 1194 | 1728 | 7.6 | 57.5 | 99,374 | >110,000 | 1372 | 1694 | 7.3 | 64.4 | 109,085 |
| IS 1 | 1.3 | 1234 | 1760 | 7.5 | 65.5 | 115,311 | >110,000 | 1315 | 1650 | 6.2 | 75.2 | 124,009 |
| IS 2 | 0.8 | 1156 | 1730 | 7.8 | 74.8 | 129,380 | >110,000 | 1281 | 1632 | 7.3 | 79.3 | 129,453 |
| IS 3 | 0.5 | 1069 | 1629 | 8.7 | 78.2 | 127,352 | >110,000 | 1316 | 1611 | 7.6 | 88.3 | 142,165 |
| CS 3 | 3.6 | 1270 | 1890 | 7.3 | 57.4 | 108,486 | >110,000 | | 1804 | | 63.4 | 114,374 |
| CS 4 | 3.4 | 1281 | 1880 | 6.5 | 56.7 | 106,596 | >110,000 | 1451 | 1799 | 6.5 | 63.6 | 114,416 |
| CS 5 | 3.6 | 1252 | 1810 | 6.4 | 52.0 | 94,120 | >110,000 | 1299 | 1720 | 6.0 | 57.0 | 98,040 |
| CS 6 | 3.4 | 1264 | 1844 | 6.2 | 48.2 | 88,881 | >110,000 | 1286 | 1740 | 5.9 | 49.1 | 85,434 |
| IS 4 | 1.5 | 1264 | 1832 | 6.8 | 67.1 | 122,744 | >110,000 | 1399 | 1736 | 6.5 | 73.2 | 127,075 |
| IS 5 | 0.6 | — | — | — | — | — | >100,000 | — | — | — | — | — |
| CS 7 | 3.4 | 1324 | 1934 | 5.8 | 47.0 | 90,898 | >100,000 | 1460 | 1825 | 6.3 | 53.0 | 96,725 |
| IS 6 | 1.6 | 1254 | 1844 | 6.5 | 55.2 | 101,420 | >100,000 | 1407 | 1754 | 6.3 | 64.3 | 112,782 |
| IS 7 | 1.6 | 1246 | 1860 | 6.7 | 56.2 | 104,160 | >100,000 | 1414 | 1768 | 6.2 | 61.4 | 108,555 |
| IS 8 | 1.6 | 1295 | 1850 | 6.5 | 56.3 | 103,600 | >100,000 | 1432 | 1768 | 6.3 | 62.2 | 109,970 |
| IS 9 | 1.1 | 1328 | 1870 | 6.3 | 55.1 | 102,850 | >100,000 | 1430 | 1785 | 6.1 | 64 | 114,240 |
| CS 8 | 5.0 | 1377 | 1940 | 5.8 | 43.4 | 84,196 | >100,000 | 1425 | 1800 | 6.0 | 53 | 95,400 |

CS: Comparative Steel,
IS: Inventive Steel

First, material properties after a hot press forming (HPF) heat treatment process were compared to evaluate the test results on the bendability of the cold-rolled steel sheets (Inventive Steels 1 to 4 and Comparative Steels 1 to 6).

As illustrated in Table 2, when values of strength=bend angle of Comparative Steels 1 to 6 having a relatively high Mn/Si ratio were compared with values of strength=bend angle of Inventive Steels 1 to 4 having an Mn/Si ratio within the range proposed in the embodiments of the present disclosure, although Inventive Steels 1 to 4 had a relatively low Mn/Si ratio, the values of strength×bend angle of Inventive Steels 1 to 4 were relatively high. That is, before hot press forming process, non-uniform microstructures such as a banded structure were reduced owing to reduced Mn content and increased Si content, and thus the bendability of the inventive steels were markedly improved after the hot press forming process. In general, when painting baking treatment process is performed on steel sheets after the steel sheets are cooled in dies, yield strength and bendability increase, and tensile strength decreases slightly. After a painting baking treatment process, the bendability of the inventive steels having an Mn/Si ratio within the range of 2 or less was improved much more than the comparative steels as shown in tensile strength×bendability balance values.

The aluminum coated steel sheets (Inventive Steels 5 to 9 and Comparative Steels 7 and 8) had similar properties. However, when cold-rolled steel sheets and aluminum coated steel sheets having the same composition were compared, the bendability of the aluminum coated steel sheets was lower than the bendability of the cold-rolled steel sheets by about 5° to 10°. Reasons for this were the suppression of surface decarbonization by coated layers and the concentration of stress caused by cracks in the coated layers. Therefore, due to this characteristics, a reference range for the tensile strength×bendability balance of cold-rolled steel sheets was set to be 110.00 MPa·° or greater, and a reference range for the tensile strength×bendability balance of aluminum coated steel sheets was set to be 100,000 MPa·° or greater. The cold-rolled steel sheets formed of the inventive steels had tensile strength×bendability balance values within the range of 115,000 MPa·° to 129,000 MPa·°, and the aluminum coated steel sheets of the inventive steels had tensile strength×bendability balance values within the range of 101,000 MPa·° to 104,000 MPa·°. That is, both the cold-rolled steel sheets and the aluminum coated steel sheets satisfied the reference ranges.

formed while maintaining an entrance temperature to be 500° C. and an exit temperature to be 450° C., so as to manufacture cold-rolled steel sheets. The other of the cold rolled full hard steel sheets were annealed at 760° C. and were dipped into a coating bath including 90% Al-9% Si and a balance of iron (Fe) and other impurities, so as to manufacture aluminum coated (AlSi coated) steel sheets having a coating weight of 150 g/m$^2$ to 160 g/m$^2$ based on both sides.

Referring to Table 3, since inventive steels included silicon (Si) in an amount of 0.5 wt % or greater, the inventive steels were clearly distinguishable from steels of the related art for hot press forming in terms of the ratio of Mn/Si. The inventive Steels had an Mn/Si ratio within the range of 0.5 to 2, and steels to which silicon (Si) and manganese (Mn) were added according to the related art had an Mn/Si ratio within the range of 3.6 to 4.5. The steels of the related art were mentioned as comparative steels. Although Inventive Steel 5 had an Mn/Si ratio within the range proposed in the embodiments of the present disclosure, the content of silicon (Si) in Inventive Steel 5 was excessive, and thus red scale was markedly formed on the surface of hot-rolled steel sheet of Inventive Steel 5. The red scale remained in the shape of bands having different surface roughness after the cold rolling process, and thus an intended degree of surface quality could not be obtained.

TABLE 3

| | Composition (wt %) | | | | | | | | | | | | | Mn/ |
|---|---|---|---|---|---|---|---|---|---|---|---|---|---|---|
| No. | C | Si | Mn | P* | S* | s-Al | Ti | Cr | B* | Mo | Cu | Ni | N* | Si |
| CS 1 | 0.36 | 0.26 | 1.1 | 110 | 27 | 0.033 | 0.030 | 0.195 | 18 | 0.08 | — | — | 44 | 4.2 |
| CS 2 | 0.36 | 0.25 | 1.1 | 110 | 27 | 0.027 | 0.029 | 0.196 | 18 | — | — | — | 43 | 4.4 |
| CS 3 | 0.35 | 0.28 | 1.1 | 57 | 6 | 0.042 | 0.031 | 0.20 | 20 | 0.08 | — | — | 40 | 3.9 |
| IS 1 | 0.37 | 0.55 | 0.89 | 73 | 16 | 0.032 | 0.025 | 0.20 | 30 | 0.11 | — | — | 53 | 1.6 |
| IS 2 | 0.36 | 0.7 | 0.90 | 67 | 26 | 0.026 | 0.031 | 0.20 | 26 | 0.12 | — | — | 45 | 1.3 |
| IS 3 | 0.37 | 1.07 | 0.89 | 57 | 14 | 0.03 | 0.024 | 0.48 | 27 | 0.09 | — | — | 49 | 0.8 |
| IS 4 | 0.36 | 1.00 | 1.30 | 80 | 18 | 0.022 | 0.025 | 0.48 | 32 | 0.09 | — | — | 51 | 1.3 |
| IS 5 (red scale) | 0.35 | 1.60 | 0.90 | 82 | 22 | 0.025 | 0.03 | 0.20 | 25 | 0.12 | — | — | 33 | 0.6 |
| CS 4 | 0.35 | 0.25 | 0.90 | 54 | 11 | 0.030 | 0.030 | 0.20 | 25 | — | — | — | 40 | 3.6 |
| CS 5 | 0.35 | 0.28 | 1.1 | 57 | 6 | 0.042 | 0.031 | 0.20 | 20 | 0.08 | — | — | 40 | 3.9 |
| IS 6 | 0.35 | 0.6 | 1.10 | 67 | 8 | 0.025 | 0.031 | 0.20 | 22 | 0.10 | — | — | 33 | 1.8 |
| IS 7 | 0.35 | 0.65 | 0.90 | 72 | 18 | 0.029 | 0.025 | 0.20 | 26 | 0.11 | — | — | 25 | 1.4 |
| IS 8 | 0.35 | 0.70 | 0.90 | 57 | 8 | 0.024 | 0.028 | 0.20 | 30 | 0.15 | 0.10 | — | 22 | 1.3 |
| IS 9 | 0.34 | 0.60 | 1.00 | 45 | 12 | 0.03 | 0.032 | 0.20 | 19 | 0.10 | — | 0.20 | 28 | 1.7 |
| IS 10 | 0.34 | 0.55 | 1.00 | 87 | 18 | 0.025 | 0.03 | 0.20 | 22 | 0.07 | 0.30 | 0.16 | 30 | 1.8 |
| CS 6 | 0.35 | 0.20 | 0.90 | 112 | 20 | 0.036 | 0.035 | 0.20 | 25 | 0.10 | — | — | 23 | 4.5 |

CS: Comparative Steel,
IS: Inventive Steel

Example 2

Hot press formed products having a strength of 1900 MPa or greater after a hot press forming process, specifically, 2000 MPa grade hot press formed products, were manufactured as follows. First, slabs having compositions as illustrated in Table 3 were heated to 1200° C. to homogenize the microstructure of the slabs. Thereafter, the slabs are rough rolled, finish rolled, and then coiled at 650° C. so as to manufacture hot-rolled steel sheets having a thickness of 3.0 mm. Then, the hot-rolled steel sheets were pickled and cold rolled at a reduction ratio of 50% so as to manufacture cold rolled full hard steel sheets having a thickness of 1.5 mm. Thereafter, some of the cold rolled full hard steel sheets were annealed at 780° C., and an overaging process was per- The cold-rolled steel sheets and the aluminum coated steel sheets manufactured as described above were heated to 930° C. for 5 minutes to 7 minutes and were transferred from a heating furnace to a press machine equipped with flat dies in which the steel sheets were cooled. At that time, a period of time from time at which the steel sheets were removed from the heating furnace to time at which the flat dies were closed was 8 seconds to 12 seconds, and the steel sheets were cooled in the flat dies at a cooling rate of 50° C./s to 100° C./s. Then, for painting baking treatment process, the steel sheets were maintained at a temperature of 170° C. to 180° C. for 20 minutes and were air cooled, and the tensile characteristics and bendability of the steel sheets were evaluated. Oxide scale formed on the surfaces of the cold-rolled steel sheets during the above-described processes was removed through a shot blasting process after a heat treatment process.

Tensile specimens were taken from the steel sheets in the direction parallel to the rolling direction of the steel sheets according to ASTM370A. A bending test was performed by bending each of 60 mm×20 mm specimens using a 1R punch in the direction perpendicular to the rolling direction (a bend line was parallel with the rolling direction), and measuring a bend angle at the maximum load.

TABLE 4

| | | Properties after HPF heat treatment | | | | | | Properties after HPF heat treatment and painting baking treatment | | | | |
|---|---|---|---|---|---|---|---|---|---|---|---|---|
| No. | Mn/Si | YS | TS | El | Bend angle | TS × Bend angle | Reference | YS | TS | El | Bend angle | TS × Bend angle |
| CS 1 | 4.2 | 1439 | 2094 | 5.9 | 43.1 | 90,251 | >100,000 | 1590 | 1966 | 5.9 | 47.0 | 92,402 |
| CS 2 | 4.4 | 1361 | 2059 | 4.9 | 44.6 | 91,831 | >100,000 | 1555 | 1920 | 6.3 | 49.0 | 94,030 |
| CS 3 | 3.9 | 1345 | 2023 | 5.6 | 45.3 | 91,642 | >100,000 | 1502 | 1914 | 6.1 | 53.1 | 101,633 |
| IS 1 | 1.6 | 1320 | 2040 | 6.3 | 49.5 | 100,980 | >100,000 | 1525 | 1925 | 6.0 | 50.6 | 97,405 |
| IS 2 | 1.3 | 1377 | 2034 | 5.7 | 53 | 107,802 | >100,000 | 1544 | 1920 | 6 | 55 | 105,600 |
| IS 3 | 0.8 | 1375 | 2125 | 6.0 | 49.6 | 105,400 | >100,000 | 1560 | 2015 | 5.9 | 60.1 | 121,102 |
| IS 4 | 1.3 | 1420 | 2170 | 5.6 | 44.4 | 96,348 | >100,000 | 1566 | 2035 | 5.8 | 54.4 | 110,704 |
| IS 5 | 0.6 | 1344 | 2001 | 6.2 | 54 | 108,054 | >100,000 | 1480 | 1890 | 6.5 | 61 | 115,290 |
| (red scale) | | | | | | | | | | | | |
| CS 4 | 3.6 | 1306 | 1977 | 6.5 | 51.7 | 102,186 | >100,000 | 1506 | 1877 | 5.5 | 55.9 | 105,033 |
| CS 5 | 3.9 | 1395 | 2047 | 5.2 | 35.5 | 72,669 | >90,000 | 1514 | 1924 | 6 | 43.4 | 83,502 |
| IS 6 | 1.8 | 1356 | 2040 | 5.8 | 45.6 | 93,024 | >90,000 | 1535 | 1933 | 6 | 50.1 | 96,843 |
| IS 7 | 1.4 | 1355 | 2033 | 6 | 46.2 | 93,925 | >90,000 | 1539 | 1920 | 5.5 | 49.3 | 94,656 |
| IS 8 | 1.3 | 1366 | 2030 | 5.4 | 45 | 91,350 | >90,000 | 1544 | 1924 | 5.4 | 53.1 | 102,164 |
| IS 9 | 1.7 | 1320 | 2015 | 6.1 | 46 | 92,690 | >90,000 | 1512 | 1905 | 5.6 | 50.2 | 95,631 |
| IS 10 | 1.8 | 1333 | 2032 | 6.2 | 45.5 | 92,456 | >90,000 | 1533 | 1932 | 5.6 | 51.2 | 98,918 |
| CS 6 | 4.5 | 1356 | 2043 | 5.8 | 40 | 81,720 | >90,000 | 1557 | 1945 | 5.3 | 44.4 | 86,358 |

CS: Comparative Steel,
IS: Inventive Steel

Table 4 above illustrates results of evaluation on tensile characteristics and bendability of Inventive Steels 1 to 10 and Comparative Steels 1 to 6 after a hot press forming process and a painting baking treatment process. In Table 4, YS, TS, and El refer to yield strength, tensile strength, and elongation, respectively. In Table 4, Inventive Steels 1 to 5 and Comparative Steels 1 to 4 are those used to form the cold-rolled steel sheets, and Inventive Steels 6 to 10 and Comparative Steels 5 and 6 are those used to form the aluminum coated steel sheets.

First, material properties after hot press forming (HPF) heat treatment process were compared to evaluate the test results on the bendability of the cold-rolled steel sheets (Inventive Steels 1 to 5 and Comparative Steels 1 to 4). When values of strength×bendability of Comparative Steels 1 to 4 having a relatively high Mn/Si ratio were compared with values of strength×bendability of Inventive Steels 1 to 5 having an Mn/Si ratio within the range proposed in the embodiments of the present disclosure, although Inventive Steels 1 to 5 had a relatively low Mn/Si ratio, the values of strength×bendability of Inventive Steels 1 to 5 were relatively high. That is, before a hot press forming process, non-uniform microstructures such as a banded structure were reduced owing to reduced Mn content and increased Si content, and thus the bendability of the inventive steels was markedly improved after the hot press forming process. In general, when a painting baking treatment process is performed on steel sheets after the steel sheets are cooled in dies, yield strength and bendability increase, and tensile strength decreases slightly. After painting baking treatment process, the bendability of the inventive steels having an Mn/Si ratio within the range of 2 or less was improved much more than the comparative steels as shown in tensile strength×bendability balance values.

The aluminum coated steel sheets (Inventive Steels 6 to 10 and Comparative Steels 5 to 6) had similar properties. However, when cold-rolled steel sheets and aluminum coated steel sheets having the same composition were compared, the bendability of the aluminum coated steel sheets was lower than the bendability of the cold-rolled steel sheets by about 5° to 10°. Reasons for this were the suppression of surface decarbonization by coating layers and the concentration of stress caused by cracks in the coating layers. Therefore, due to this characteristics, a reference range for the tensile strength×bendability balance of cold-rolled steel sheets was set to be 95,000 MPa·° or greater, and a reference range for the tensile strength×bendability balance of aluminum coated steel sheets was set to be 85,000 MPa·° or greater. The cold-rolled steel sheets formed of the inventive steels had tensile strength×bendability balance values within the range of 96,000 MPa·° to 108,000 MPa·°, and the aluminum coated steel sheets formed of the inventive steels had tensile strength×bendability balance values within the range of 91,000 MPa·° to 93,000 MPa·°. That is, both the cold-rolled steel sheets and the aluminum coated steel sheets satisfied the reference ranges.

While exemplary embodiments have been shown and described above, it will be apparent to those skilled in the art that modifications and other embodiments could be made therefrom. That is, such modifications and other embodiments could be made without departing from the scope of the present invention as defined by the appended claims.

The invention claimed is:

1. A steel sheet for a formed product having high bendability and ultra-high strength, the steel sheet comprising C: 0.28 wt % to 0.40 wt %, Si: 0.5 wt % to 1.5 wt %, Mn: 0.5 wt % to 1.2 wt %, Al: 0.01 wt % to 0.1 wt %, Ti: 0.01 wt % to 0.1 wt %, Cr: 0.05 wt % to 0.5 wt %, P: 0.01 wt % or less, S: 0.005 wt % or less, N: 0.01 wt % or less, B: 0.0005 wt % to 0.005 wt %, and at least one selected from the group consisting of Mo: 0.05 wt % to 0.5 wt %, Cu: 0.05 wt % to 0.5 wt %, and Ni: 0.05 wt % to 0.5 wt %, wherein Mn and Si satisfies $0.05 \leq Mn/Si \leq 2$, and the steel sheet comprises a balance of Fe and other inevitable impurities, and wherein the steel sheet has a microstructure consisting of ferrite and less than 40% of pearlite, or a microstructure consisting of ferrite and less than 40% of pearlite and bainite.

2. The steel sheet of claim 1, wherein the steel sheet is at least one selected from the group consisting of a hot-rolled steel sheet, a pickled steel sheet, a cold-rolled steel sheet, and a coated steel sheet.

3. The steel sheet of claim 2, wherein the coated steel sheet is an aluminum alloy coated steel sheet manufactured by forming an aluminum alloy coating layer on a hot-rolled steel sheet, a pickled steel sheet, or a cold-rolled steel sheet.

4. The steel sheet of claim 3, wherein the aluminum alloy coated steel sheet comprises an alloy coating layer comprising at least one selected from the group consisting of Si: 8 wt % to 10 wt % and Mg: 4 wt % to 10 wt %, and a balance of Al, Fe, and other impurities.

5. A hot press formed product having high bendability and ultra-high strength, manufactured by performing a hot press forming process on the steel sheet of claim 1, the steel sheet comprising C: 0.28 wt % to 0.40 wt %, Si: 0.5 wt % to 1.5 wt %, Mn: 0.5 wt % to 1.2 wt %, Al: 0.01 wt % to 0.1 wt %, Ti: 0.01 wt % to 0.1 wt %, Cr: 0.05 wt % to 0.5 wt %, P: 0.01 wt % or less, S: 0.005 wt % or less, N: 0.01 wt % or less, B: 0.0005 wt % to 0.005 wt %, and at least one selected from the group consisting of Mo: 0.05 wt % to 0.5 wt %, Cu: 0.05 wt % to 0.5 wt %, and Ni: 0.05 wt % to 0.5 wt %, wherein Mn and Si satisfies $0.05 \leq Mn/Si \leq 2$, and the steel sheet comprises a balance of Fe and other inevitable impurities.

6. The formed product of claim 5, wherein the steel sheet is an aluminum alloy coated steel sheet, and the formed product comprises an Fe—Al film layer, wherein the Fe—Al film layer comprises at least one selected from the group consisting of Si: 4 wt % to 10 wt % and Mg: 2 wt % to 10 wt %, and other impurities.

7. The formed product of claim 5, wherein the formed product comprises a microstructure comprising martensite in an amount of 90 area % or greater, retained austenite in an amount of less than 5 area %, and a balance of at least one selected from retained bainite and ferrite.

8. The formed product of claim 5, wherein the formed product has a tensile strength of 1700 MPa or greater.

* * * * *